United States Patent [19]

Scott et al.

[11] Patent Number: 4,591,474

[45] Date of Patent: May 27, 1986

[54] METHOD FOR CASTING CONCRETE MEMBERS

[75] Inventors: Harold H. Scott, Martinez, Calif.; Ralph K. Scott, Kennewick, Wash.

[73] Assignee: Columbia Fabricators, Kennewick, Wash.

[21] Appl. No.: 594,477

[22] Filed: Mar. 28, 1984

Related U.S. Application Data

[63] Continuation of Ser. No. 354,066, Mar. 2, 1982, abandoned.

[51] Int. Cl.[4] ..... B28B 1/16

[52] U.S. Cl. ..... 264/253; 210/540; 264/256; 264/298; 264/317

[58] Field of Search ..... 264/298, 219, 253, 256, 264/317; 210/538, 540

[56] References Cited

U.S. PATENT DOCUMENTS

| | | | |
|---|---|---|---|
| 782,065 | 2/1905 | Shaler | 210/540 |
| 1,169,985 | 2/1916 | Mickelson | 264/255 |
| 1,234,244 | 7/1917 | Willsie | 264/253 |
| 1,291,412 | 1/1919 | Clawson | 210/540 |
| 1,291,588 | 1/1919 | Maves | 164/35 |
| 1,679,345 | 8/1928 | Austin | 264/86 |
| 1,809,504 | 6/1931 | Carvel | 52/745 |
| 1,856,906 | 5/1932 | Carvel | 264/256 |
| 1,888,234 | 11/1932 | Miller | 264/33 |
| 1,916,308 | 7/1933 | Grieco | 52/315 |
| 1,960,276 | 5/1934 | Miller | 425/441 |
| 2,189,872 | 2/1940 | Ulrich | 264/34 |
| 2,305,126 | 12/1942 | Wohl | 264/74 |
| 2,408,005 | 9/1946 | Slatis | 164/35 |
| 2,454,910 | 11/1948 | Carr | 264/112 |
| 2,479,386 | 8/1949 | Matheis | 210/540 |
| 2,480,048 | 8/1949 | Rice | 264/19 |
| 2,689,982 | 9/1954 | Chynoweth | 264/298 |
| 3,021,565 | 2/1962 | Bowman | 264/134 |
| 3,047,908 | 8/1962 | Lundgren | 264/42 |
| 3,302,257 | 2/1967 | Kaplan | 249/57 |
| 3,331,175 | 7/1967 | Terrio | 52/315 |
| 3,390,496 | 7/1968 | Weiner | 52/232 |
| 3,479,786 | 11/1969 | Kreier, Jr. | 52/745 |
| 3,484,511 | 12/1969 | Delrieux | 264/57 |
| 3,608,051 | 9/1971 | Scott | 264/261 |
| 3,689,626 | 9/1972 | Scott | 264/253 |

FOREIGN PATENT DOCUMENTS

| | | |
|---|---|---|
| 643884 | 7/1962 | Canada . |
| 300492 | 9/1917 | Fed. Rep. of Germany . |
| 712891 | 8/1954 | United Kingdom . |

*Primary Examiner*—Jay H. Woo
*Assistant Examiner*—James C. Housel
*Attorney, Agent, or Firm*—Klarquist, Sparkman, Campbell, Leigh & Whinston

[57] ABSTRACT

A method of forming a concrete member is provided which includes the following steps: in a mold structure having a plurality of lateral walls defining a cavity, introducing a liquid into the cavity to a predetermined level above a drainage conduit which leads to a weir having an upper edge which is higher than the liquid level; forming a layer of fusible material on the surface of the liquid, the fusible material being of lesser density than the liquid and having a melting point which is above the temperature of the liquid, by introducing molten fusible material into the cavity until the liquid begins to flow over the weir; after the fusible material has solidified, introducing a concrete mix into the cavity onto the fusible material; when the concrete mix is at least partially cured, establishing a flow of warm liquid into the cavity below the fusible material and over the weir, the warm liquid having a temperature above the melting point of the fusible material so that the fusible material is melted; draining the molten fusible material from the cavity; and draining the liquid from the cavity.

10 Claims, 6 Drawing Figures

FIG. 2
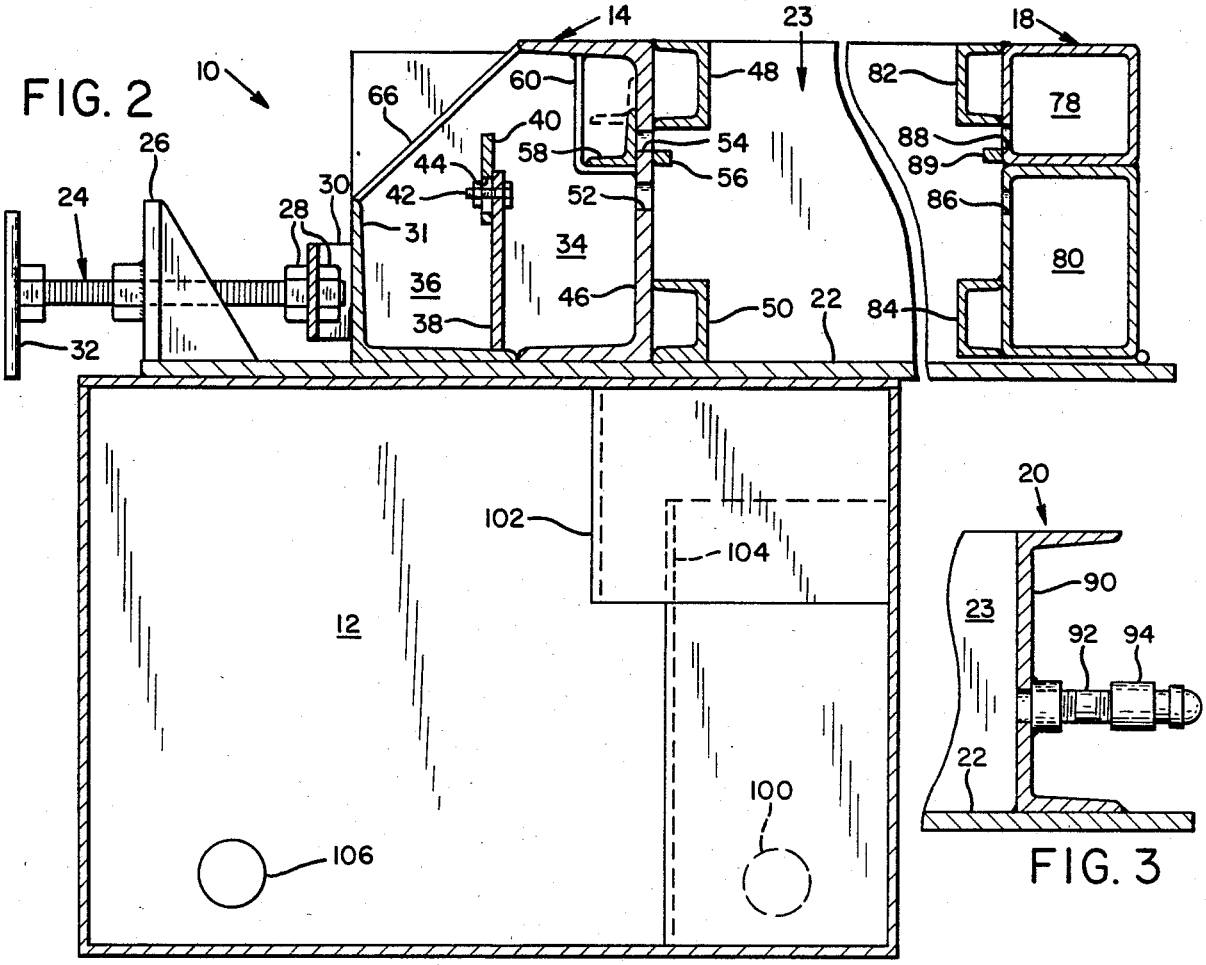
FIG. 3
FIG. 4
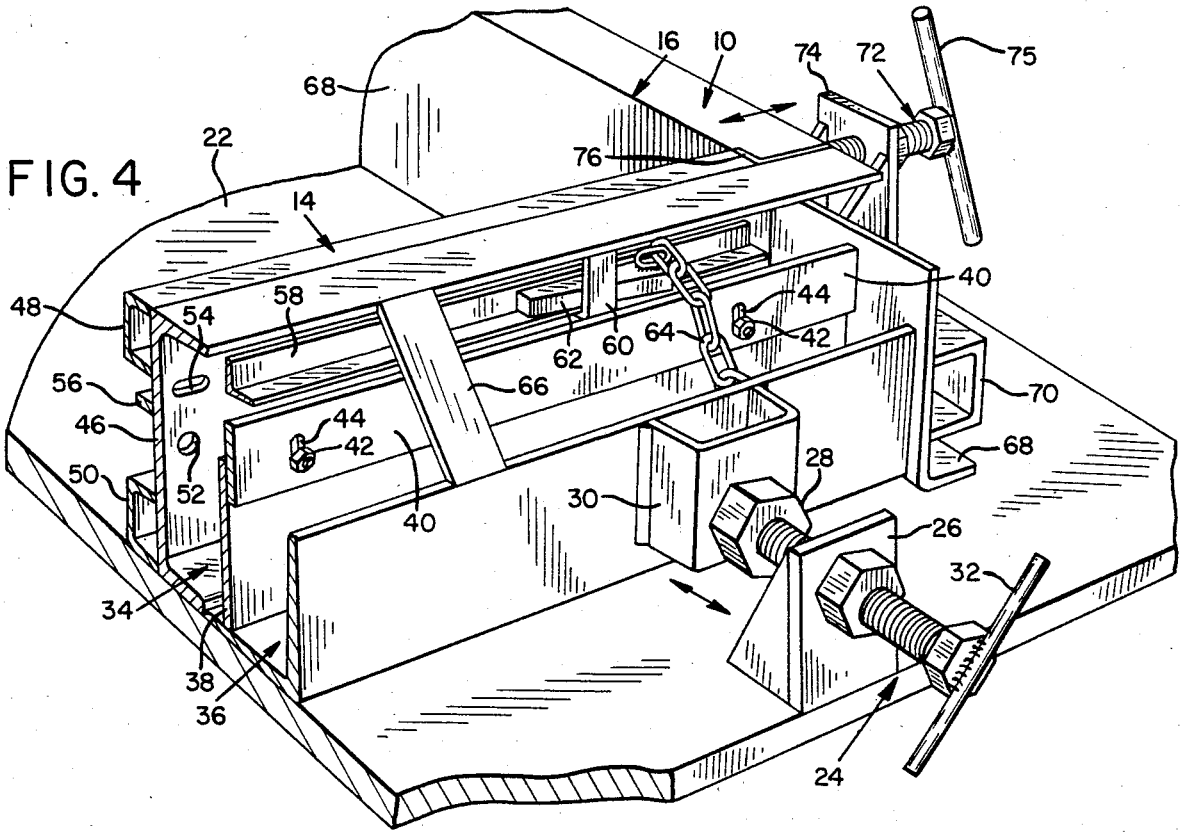

METHOD FOR CASTING CONCRETE MEMBERS

This is a continuation of application Ser. No. 354,066, filed Mar. 2, 1982, now abandoned.

BACKGROUND OF THE INVENTION

1. Field of the Invention

The present invention relates generally to a method and apparatus for casting concrete members, and more particularly to a method and apparatus for casting multiple-slab, hollow-core concrete members having structural tying members extending between the slabs.

2. Discussion of the Prior Art

In casting some concrete members, it is advantageous to use molten wax cooled to a solid state as the bottom of the mold or form. For example, concrete panels having embedded decorative or functional elements in one surface can be advantageously formed using a wax mold bottom, as shown in Terrio U.S. Pat. No. 3,331,175. However, until recent years, those in the art had not been able to develop techniques which permitted easy removal of all of the wax from the cast slab and casting bed after the concrete had cured. One of the first successful attempts is disclosed in U.S. Pat. No. 3,608,051. This patent teaches a method in which hot water or steam is directed around the mold members and into direct contact with exposed peripheral edges of the wax layer to melt the wax and thus remove it from the slab and mold. This was an improvement over earlier proposals in that the wax is substantially completely removed and can be separated from the hot water for reuse.

A variation of this technique is disclosed in U.S. Pat. No. 3,689,626 for casting multiple-slab, hollow-core concrete panels. In this method, wax is used to cast concrete members having two or more spaced apart slabs with structural steel tying members joining them together. In the method of this patent, a first layer of wet concrete is poured into a mold formed within an enclosed water-tight tank. The concrete is poured onto a mold bottom formed by a layer of solidified wax at least partially supported by a pool of water below the wax layer. Upwardly extending tying members are embedded in the wet concrete and a second layer of water is introduced into the tank. Molten wax is introduced into the tank to cover the water and to form, when solidified, a second mold bottom spaced above the first slab. Cold water is circulated below the wax layer to cool and solidify the wax to form the second mold bottom. The height of the wax layer is such that the tying members extend above. When the wax has solidified, a second layer of wet concrete is poured onto the suspended wax layer to cover the upper ends of the tying members and form the second slab. When this upper layer of concrete has set sufficiently to be self-sustaining, the cold water in the tank is displaced by hot water, and hot water is circulated through the tank until all of the wax is melted and removed through an appropriate tube.

The method just described is a great improvement over prior methods of forming multiple slab hollow panels. The system depends, however, on the construction of a large water-tight tank with suitable casting deck forming the bottom of the tank or construction within the tank. All form work for the concrete structures to be made therein are independent of the tank and deck structure. Thus, any size or shape of panel could be formed so long as it did not exceed the area limits of the casting deck. When the product to be made required the embedding of decorative materials, a reticulated structure was placed within the tank to serve as a casting deck. Since the perimeter forms for containing concrete were inside the tank perimeter, it was necessary to use a cover over the entire surface of the tank during the curing operations in order to prevent undue heat loss.

While such method provides great flexibility in terms of the variety of products which can be produced, the system does not lend itself to portability. The whole system is larger and more cumbersome than required to make quantities of products having predetermined dimensions.

Hence, it is a primary object of the present invention to provide a method, apparatus, and system for casting concrete members which are improvements over those disclosed in U.S. Pat. No. 3,689,626, and which effectively and reliably overcome the drawbacks and limitations of the prior art proposals. More specifically, the present invention has as its objects one or more of the following taken individually or in combination.

(1) To provide a self-contained, portable system for casting concrete members;

(2) The provision of self-contained wax and water distribution channels and drainage channels in a system for casting concrete members;

(3) To provide means for simply and accurately controlling water level in a concrete casting system for casting multiple slab castings with structural members extending therebetween;

(4) The development of valve means which expedites removal of wax from a concrete casting mold;

(5) To provide a method and system for casting multiple-slab, hollow-core concrete panels on any flat bed without the need for a special water-tight tank in which to place the mold;

(6) To provide a method and system for casting multiple-layer, hollow-core concrete panels which can be utilized efficiently at a job site;

(7) To provide a method and system for casting multiple-layer concrete panels in which the perimeter forms for the finished product combine with the deck on which they are placed to form the container necessary for containment of liquids required in the process;

(8) To provide a method and system for casting multiple-layer concrete panels without the need for a structural cover during curing operations; and (9) To develop a casting system which is versatile in that it can be easily modified to cast panels of a wide variety of dimensions.

SUMMARY OF THE INVENTION

This invention responds to the problems presented in the prior art by providing a method of forming a concrete member which includes the following steps: (1) in a mold structure having a plurality of lateral walls defining a cavity, introducing a liquid into the cavity to a predetermined level above a drainage conduit which leads to a weir having an upper edge which is higher than the liquid level; (2) forming a layer of fusible material on the surface of the liquid, the fusible material being of lesser density than the liquid and having a melting point which is above the temperature of the liquid, by introducing molten fusible material into the cavity until the liquid begins to flow over the weir, whereby the upper level of the fusible material is determined by the height of the weir; (3) after the fusible material has solidified, introducing a concrete mix into the cavity onto the fusible material; (4) when the concrete mix is at least partially cured, establishing a flow of warm liquid into the cavity below the fusible material and over the weir, the warm liquid having a temperature above the melting point of the fusible material so that the fusible material is melted; (5) draining the molten fusible material from the cavity; and (6) draining the liquid from the cavity.

The invention thus provides means for accurately controlling the water and wax levels in a concrete casting system which is simple yet effective. The invention also eliminates the need for a water-tight tank.

Another way to define the invention is as a mold structure for casting a concrete member. So defined, the structure includes the following components: (1) a centrally disposed cavity defined by a plurality of lateral walls; (1) liquid distribution means in one of the walls for distributing liquid into the cavity; (2) molten fusible material distribution means in one of the walls for distributing molten fusible material into the cavity; and (3) drainage means in another of the walls for draining liquid and molten fusible material from the cavity, the drainage means comprising a drainage conduit in the wall leading to weir means for controlling the liquid level in the cavity, and dam means disposed in the wall above the drainage conduit, the dam means being operable to control the drainage of molten fusible material from the cavity. Defined thusly, the invention provides a self-contained, portable casting system having wax and water distribution channels and drainage channels which are built into the walls of the mold structure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a fragmentary, elevational sectional view taken along line 2—2 of FIG. 1 with the center portion of the casting bed deleted;

FIG. 3 is an elevational sectional view taken along line 3—3 of FIG. 1;

FIG. 4 is a fragmentary perspective view of drainage means of a movable side channel which may be used with the embodiment of FIG. 1;

DETAILED DESCRIPTION OF THE PREFERRED EMBODIMENT

Construction of the Casting Bed

Figure 5:
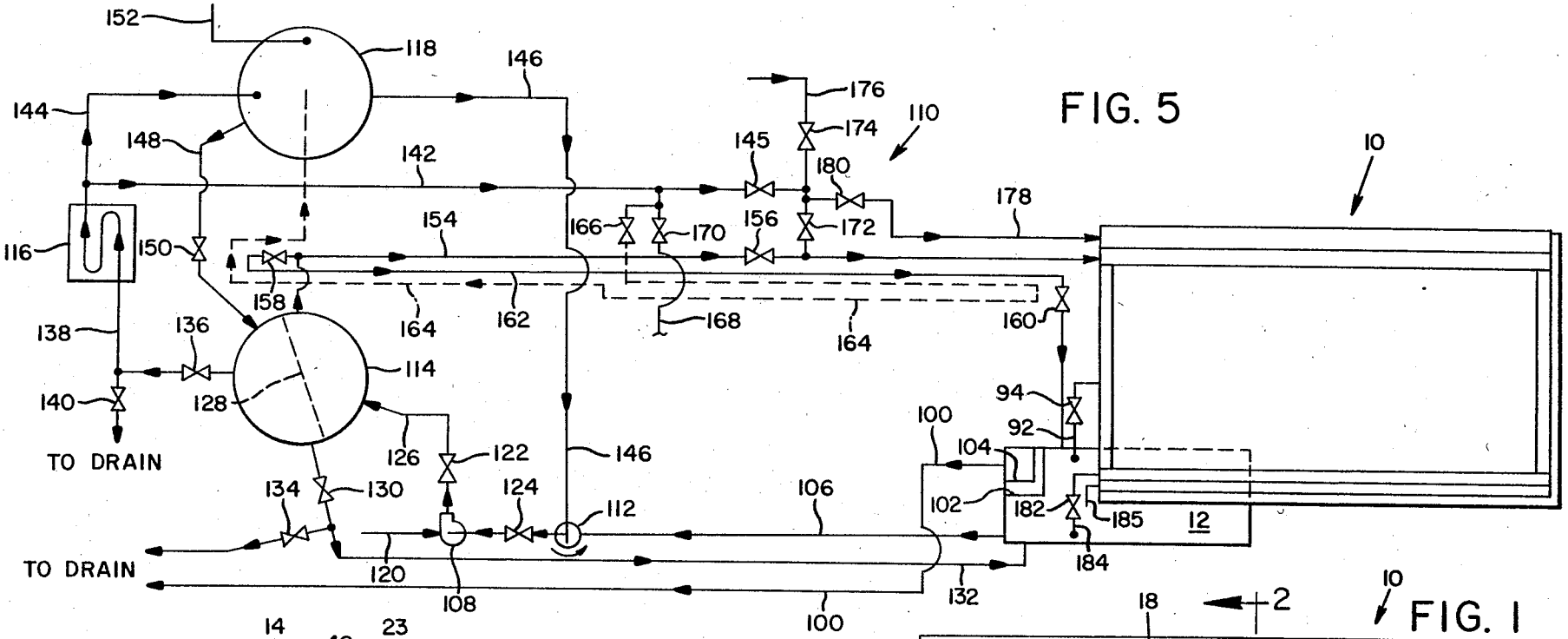
FIG. 5 is a schematic diagram of a suitable system for supplying water and molten wax to the casting bed of FIG. 1.
Figure 1:
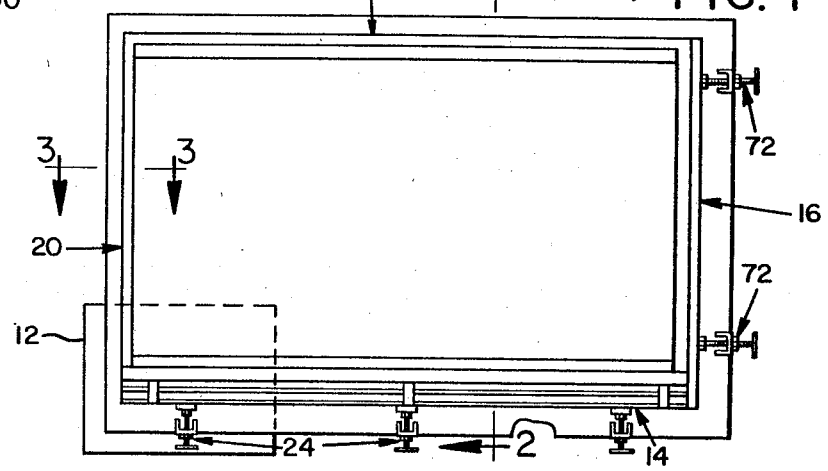
FIG. 1 is a plan view of a casting bed used with a preferred embodiment of the present invention.

A suitable casting bed 10 for making large scale concrete panels, such as those used in building construction, is shown in plan view in FIGS. 1 and 5. A sump 12 is indicated partially in phantom below one corner of casting bed 10. The periphery of casting bed 10 is defined by a movable side channel 14, a movable end channel 16, a fixed side channel 18, and a fixed end channel 20.

Movable side channel 14 is best depicted in FIGS. 2 and 4 and includes means for controlling the drainage of a fusible material and a liquid from casting bed 10. The fusible material normally used with the invention is petroleum wax, and water is the liquid normally used. Therefore, this description will deal only with these materials. It should be appreciated, however, that other conventional materials may alternatively be utilized.

Movable side channel 14 rests upon a casting bed top plate 22 which, together with side and end channels 16, 18, and 20, defines a casting bed cavity 23. Movable side channel 14 is adapted to be moved inwardly and outwardly through the use of a plurality of evenly spaced jack screws 24, thereby permitting cavity 23 to be opened at the corners for drainage of water from the cavity and to facilitate removal of the concrete member. Each of the jack screws 24 is threaded into a jack screw mounting plate 26 which is affixed to casting bed top plate 22. Jack screws 24 are affixed at one end to an L-shaped trough member 31 of movable side channel 14 by a pair of lock nuts 28 disposed on each side of a jack screw mounting channel 30. The end of each of the jack screws 24 which is remote from trough member 31 includes an operating lever 32 to oermit jack screws 24 to be threaded inwardly and outwardly with respect to jack screw mounting plates 26, thereby sliding movable side channel 14 along casting bed top plate 22 in an inwardly or outwardly direction.

Movable side channel 14 includes a weir chamber 34 and a trough 36 with a vertically extending division plate 38 disposed therebetween. A vertically adjustable weir 40 is mounted to division plate 38 by a plurality of bolts 42, one of which extends through each of a plurality of weir mounting slots 44. This configuration permits weir 40 to be adjusted upwardly and downwardly.

Movable side channel 14 also includes a channel member 46 which extends the length of the side channel. Upper and lower screeding channels 48 and 50 are mounted to the inner side of channel member 46 and, together with the channel member, define the inner periphery of movable side channel 14.

A plurality of water drainage ports 52 are evenly spaced along the length of channel member 46 to drain water from cavity 23 and into weir chamber 34. Wax drainage slots 54 are also included along the length of channel member 46 to drain wax from cavity 23 and into weir chamber 34. A plurality of anti-shear tongues 56 extend inwardly from channel member 46 immediately below wax drainage slots 54 to help support the perimeter of the wax layer.

An L-shaoed wax dam 58 is mounted to the outer surface of channel member 46 by a plurality of evenly spaced support clips 60 which extend between the upper horizontal and vertical portions of channel member 46. With wax dam 58 in its lowered position depicted in FIG. 4 and in solid lines in FIG. 2, wax drainage slots 54 are covered. With wax dam 58 in its raised position depicted in phantom in FIG. 2, wax drainage slots 54 are uncovered to permit wax to flow out of cavity 23.

Wax dam 58 is affixed in its lowered position by a pluralitv of wedges 62, one of which is wedged into place between the wax dam and the vertical portion of each of the support clips 60 to positively hold wax dam 58 against channel member 46 and prevent leakage of wax out of casting bed 10. Wax dam 58 is fixed in its raised position by positioning wedges 62 between the wax dam and the vertical portion of each of the support clips 60. Keeper chains 64 loosely attached wedges 62 to movable side channel 14 while permitting the wedges to be freely manipulated by the operator. Keeper chains 64 have not been shown in FIG. 2 for simplification.

In an alternative embodiment, the water drainage holes and wax drainage slots are combined into a single set of openings of enlarged height with the wax dam being disposed, in its lowered position, to cover the upper portion of the openings. This upper portion is where the wax would otherwise flow through the channel member. This alternative embodiment is not the preferred mode, however, so has not been depicted.

In the depicted embodiment, stiffening bars 66 extend between channel member 46 and trough member 31 every few feet or so to tie the trough and weir chamber portions of movable side channel 14 together.

A weir chamber drain line (not shown in FIG. 2) is provided at one end of weir chamber 34 to permit the weir chamber to be drained directly into sump 12. A weir chamber drain valve (not shown in FIG. 2), which is normally closed, controls the flow through the weir chamber drain line. Similarly, a weir overflow conduit (not shown in FIG. 2) is provided at one end of trough 36. It is normally in the form of a simple opening in the floor of the trough 36 and casting bed top plate 22 above sump 12 so that whatever flows over weir 40 will drain into the sump.

Movable end channel 16 includes a channel member 68 with a stiffening member 70 extending substantially its entire length. Channel member 68 is substantially C-shaped in cross section for its entire length except for the end which extends beyond movable side channel 14 where, as shown in FIG. 4, it is L-shaped in cross section. A joint 76 is provided between movable end channel 16 and movable side channel 14 and is typically sealed through the use of mastic or caulking or the like.

Channel member 68 is movable through the use of a pair of spaced jack screws 72 which are mounted to channel member 68 and casting bed top plate 22 as described above with respect to jack screw 24; that is, a jack screw mounting plate 74 is internally threaded to receive each of the jack screws so that when the operator rotates jack screw handles 75, channel member 68 shifts inwardly and outwardly along the surface of casting bed top plate 22. As mentioned above, this permits the corners of casting bed 10 to be opened to drain cavity 23 and to permit removal of the cast concrete member.

Fixed side channel 18 is best depicted in FIG. 2. It is substantially rectangular in cross section and comprises a wax supply header 78, a water supply header 80, and upper and lower screeding channels 82 and 84, respectively. Fixed side channel 18 is affixed to casting bed top plate 22 as by welding or other permanent means. Wax and water are provided to wax supply header 78 and water supply header 80 by conventional conduits and suitable couplings, which have not been shown in FIG. 2, but are schematically depicted in FIG. 5. A plurality of evenly spaced water supply ports 86 are provided along the length of water supply header 80, substantially in vertical alignment with water drainage ports 52 in movable side channel 14, thus ensuring that whenever the water level in water supply header 80 extends as high as water supply ports 86, water will flow into cavity 23 at an even rate. A plurality of evenly spaced wax supply ports 88 are similarly provided along the length of wax supply header 78 immediately below the lower edge of upper screeding channel 82, thus in substantial vertical alignment with wax drainage slots 54 in movable side channel 14. A plurality of antishear tongues 89 are evenly spaced along the length of wax supply header 78 immediately below the level of wax supply ports 88 to provide support for the wax layer as described above with respect to antishear tongues 52. Because wax supply ports 88 are disposed along the lower portion of wax supply header 78, whenever any substantial amount of molten wax is fed into the wax supply header, that wax will flow at an even rate through wax supply ports 88 and into cavity 23.

Fixed end channel 20 is shown in cross section in FIG. 3. It includes a substantially C-shaped channel member 90 which is affixed, such as by welding, to casting bed top plate 22. A water drain line 92 extends through channel member 90 to permit water to be drained from cavity 23. A water drain valve 94 is provided in water drain line 92 adjacent channel member 90 to control the flow of water therethrough. This valve is typically a quick opening plate-type valve to facilitate rapid drainage. Water drain line 92 drains water downwardly from cavity 23 into sump 12 which is disposed below and adjacent one corner of casting bed top plate 22. Thus, while water drainage ports 52 combine with weir 40 to control the level of water in cavity 23, water drain line 92 is utilized to remove substantially all the water from the cavity at aporopriate times during casting operations.

Sump 12 includes overflow means which permits excess water to flow out of the sump and out of the system through an overflow line 100. A wax holdback dam 102 and an overflow weir 104 combine to minimize the possibility of wax being lost from the system through overflow line 100. Return line 106 extends into sump 12 adjacent the lower portion thereof to provide water and wax to a system pump 108.

Water and Wax Preparation System

The water and wax preparation system 110 depicted in FIG. 5 will now be described. The major components of the system 110 are the aforementioned system pump 108, a three-way valve 112, a water and wax separator tank 114, a water heater 116, and a hot water supply tank 118.

System pump 108 is typically a positive displacement, air driven pump, with air being provided through an air supply line 120. Electrically driven centrifugal pumps may alternatively be used. Pump discharge and inlet valves 122 and 124, respectively, are provided at the discharge and inlet ends of pump 108. Pump 108 discharges through a separator tank inlet line 126 into separator tank 114. Separator tank 114 includes a central baffle 128 and serves as a settling tank to vertically separate the molten wax from the water.

A water recirculation valve 130 is provided in a water recirculation line 132 to permit water to be recirculated back into sump 12. Water recirculation valve 130 is normally closed but is opened at various stages of casting operations, as described further hereinbelow. A drain valve 134 is provided in a drain line leading from water recirculation line 132 to permit water to be drained from system 110 at this point.

The water which has collected in the lower portion of separator tank 114 is directed into water heater 116 via water heater inlet valve 136 and water heater inlet line 138. A drain valve 140 is also provided off of water heater inlet line 138 to permit the system 110 to be drained at this point as well. Water heater 116 is normally a conventional gas-fired water heater but may alternatively be electric. It typically includes a plurality of turns of tubing as schematically depicted in FIG. 5.

Depending upon the position of the various valves in system 110, the hot water which passes from water heater 116 will either be directed through a hot water line 142 and a hot water valve 145 toward casting bed 10, or through a supply tank inlet line 144 to hot water storage and supply tank 118 positioned above wax separator tank 114. Hot water passes from hot water supply tank 118 through either a hot water supply line 146 to three-way valve 112, or through a supply tank drain line 148 and valve 150 back to separator tank 114. Hot water supply tank 118 is vented at 152 to ensure appropriate drainage from the tank.

Molten wax which has risen to the top of separator tank 114 is directed to wax supply header 78 in casting bed 10 through hot wax line 154 and wax supply valve 156. To permit separator tank 114 to be vented without losing any wax from the system, first and second separator tank vent valves 158 and 160 are provided in a separator vent line 162 which discharges into sump 12. In order to maintain the wax in separator tank vent line 162 in a molten state, a hot water tracer line 164 is provided in close proximity to the separator tank vent line. Hot water tracer line 164 is typically constructed of copper tubing and for this reason has been indicated with dashed lines in FIG. 5. Hot water is provided to tracer line 164 from hot water line 142 via hot water tracer valve 166 and discharges into hot water supply tank 118. A water hose 168 also takes suction from hot water line 142 through water hose valve 170 at this point, for use in washing out residual wax and other debris from casting bed 10 when necessary.

In order to permit wax supply header 78 to be preheated before molten wax begins to flow into it, a wax header heating valve 172 is provided to direct hot water from hot water line 142 into hot wax line 154 immediately downstream of wax supply valve 156. This minimizes the possibility of the molten wax solidifying upon contacting otherwise cool surfaces of wax supply header.

A cold water supply valve 174 is provided in a cold water line 176 to supply cold water to casting bed 10 through a water inlet line 178. Water inlet line 178, which includes a water inlet valve 180, therefore is adapted to receive either hot water from hot water line 142 or cold water from cold water line 176 and to convey this water into casting bed 10 via water supply header 80.

As mentioned above, weir chamber drain valve 182 in weir chamber drain line 184 is provided between one end of weir chamber 34 and sump 12 to permit the weir chamber to be drained into the sump. This line and valve only appear in FIG. 5. Weir overflow conduit 185 is schematically depicted in FIG. 5, although, as mentioned above, it actually is in the form of an opening in the floor of one end of trough 36, thereby permitting drainage into sump 12.

Operation of the Depicted Embodiment

To inventory the system with water and wax for casting, all of the valves in system 110 should be closed with the exception of pump discharge and inlet valves 122 and 124 and water heater inlet valve 136. Hot water supply tank 118 is filled with an appropriate amount of water through vent 152 or other filling means (not shown). Three-way valve 112 is positioned as shown in FIG. 5 and pump 108 is started. This pumps water through separator tank 114, water heater 116, hot water supply tank 118, and three-way valve 112, thereby short circuiting casting bed 10. Water heater 116 is then energized so that the circulating water is gradually heated. When the water temperature reaches approximately 160° F., hot water valve 145 and water inlet valve 180 are opened and three-way valve 112 is rotated 90° in a counterclockwise direction so that the hot water is circulated through casting bed 10. Supply tank drain valve 148 and water recirculation valve 130 should be opened until circulation is established through pump 108, and then they may be reclosed.

Once a flow of hot water through the system is established, wax chunks (not shown) are deposited in cavity 23 of the casting bed. The circulating hot water causes the wax chunks to gradually melt, thereby forming a layer of molten wax on top of the hot water accumulated in cavity 23. When a substantial portion of the wax has melted, wax dam 58 is moved to its raised position, thereby uncovering wax drainage slots 54. This permits the now molten wax along with some water to flow into weir chamber 34 and to overflow weir 40 into trough 36 and subsequently into sump 12 via weir overflow conduit 185. Return line 106 then directs this mixture of molten wax and water into pump 108 which pumps the mixture into separator tank 114.

Separator tank 114 separates the water from the wax by permitting the water to settle downwardly while the molten wax rises upwardly. Since only water is withdrawn from separator tank 114 through water heater inlet line 138 near the bottom of the tank, molten wax will begin to accumulate in the upper portion of separator tank 114.

When a substantial amount of molten wax has accumulated in separator tank 114, first and second separator tank vent valves 158 and 160 are opened to vent separator tank 114 into sump 12. Once wax begins to flow through separator tank vent line 162, second separator tank vent valve 160 may be closed. First separator tank vent valve 158 may also be closed, but it is typically left open since the closing of valve 160 stops the flow of wax through separator tank vent line 162. First separator tank vent valve 160 is periodically reopened to vent separator tank 114. To maintain the wax in separator tank vent line 162 in a liquid state between venting operations, hot water tracer valve 166 should be periodically opened to direct hot water through hot water tracer line 164 which, as mentioned above, is in close proximity to separator tank vent line 162.

Once the wax chunks have been entirely melted, pump 108 is shut down, hot water valve 145 is closed and water drain valve 94 is opened to drain the hot water and any remaining wax out of cavity 23 and into sump 12. The drainage of casting bed 10 is completed by opening a corner of the casting bed. This is done by displacing movable side channel 14 or movable end channel 16, or both, outwardly using jack screws 24 and 72.

When all of the water is drained from casting bed 10 and pumped back into the storage tank 118, the preliminary inventory of the system is complete and will not have to be repeated in normal use. The casting bed is now ready for use.

Casting Operations

The casting operations for forming a two-layer, hollow-core concrete panel will be described, since the illustrated casting bed is adapted for forming such a panel. However, the same principles and methods will also apply in forming panels with three or more spaced layers using a modified casting bed with additional screeding channels, headers, weirs, and dams, as required, above those described.

The movable side and end channels 14 and 16 are moved inwardly until the corners of casting bed 10 are closed. The closed corners of casting bed 10 are sealed, typically, with mastic unless other sealing means is provided. If desired, casting bed top plate 22 and the inwardly facing portions of side and end channels 14, 16, 18, and 20 are sprayed with suitable mold release agents.

Figure 6:
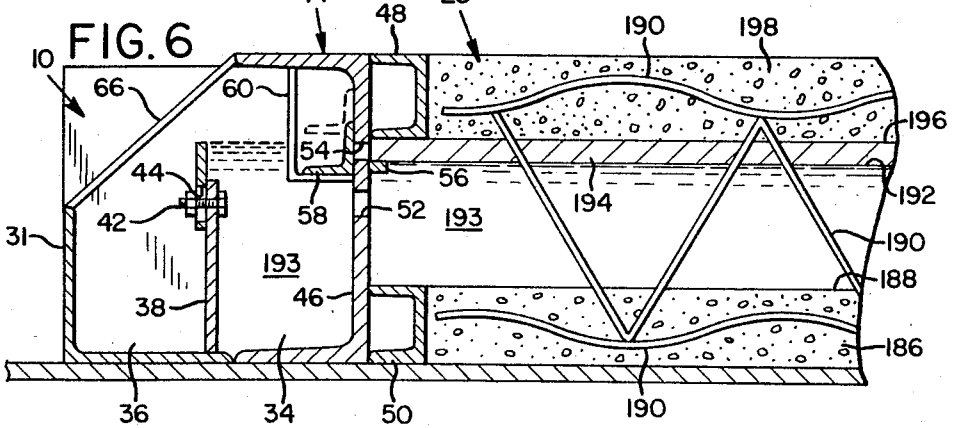
FIG. 6 is a fragmentary, elevational sectional view which is similar to FIG. 2 except that it shows the cement, water, and wax in the casting bed during casting operations.

When casting bed 10 is ready, wet concrete is poured into cavity 23 until its upper level is even with the top surfaces of lower screeding channels 50 and 84, to form the first layer of panel. This concrete layer is shown in FIG. 6 at 186, with its upper level at 188. Lower portions of appropriate structural support members, such as the the steel truss shown at 190, are embedded in the wet concrete so that their upper extremities extend well above the lower limits of upper screeding channels 48, 82. For structural strength in all directions, additional trusses (not shown) are embedded at right angles to trusses 190 to form a grid of such trusses.

Cold water valve 174 is then opened to direct cold water through cold water line 176 and water inlet line 178, into water supply header 80. It is normally desirable that the cold water be admitted slowly at first until the entire surface of concrete mix 186 is covered so as to prevent scouring such surface. However, such scouring will be largely prevented by upper surfaces of lower screeding channels 50, 84, which act as splash boards for receiving the initial cascade of water. With the concrete submerged, the water 193 may be rapidly raised to the level indicated at 192 in FIG. 6, which is slightly below the upoer edge of weir 40. Wax dam 58 is then shifted to its lowered position, concealing wax drainage slots 54. Wedges 62 are jammed in place between wax dam 58 and the vertical extension of support clips 60 to prevent any leakage through wax drainage slots 54.

Supply tank drain valve 148 is opened to exert hot water supply tank head pressure on separator tank 114. Cold water supply valve 174 and water inlet valve 180 are closed, and hot water valve 145 and wax header heating valve 172 are ooened so that hot water is gravitated into casting bed 10 through wax supply header 78, thus preheating wax supply header 78. when the water level in cavity 23 has risen approximately one-half inch, hot water valve 145 and wax header heating valve 172 are reclosed.

Wax supply valve 156 is opened, permitting molten wax 194 to flow through hot wax line 154, wax supply header 78 and wax supply ports 88, into cavity 23. When weir 40 begins to overflow with water, wax supply valve 156 is closed. At this time, the upper level of wax 194 will he at level 196, substantially coinciding with the lower edges of upper screeding channels 48 and 82. The thickness of wax layer 194 may be increased or decreased by providing lower or higher water levels, respectively, prior to the introduction of the wax into cavity 23.

After wax supply valve 156 is closed, supply tank drain valve 148 is closed and three-way valve 112 is rotated 90° clockwise to the position shown in FIG. 5. Pump 108 is started, causing water to be circulated through separator tank 114, water heater 116, hot water supply tank 118, and three-way valve 112. This circulation of the water through water heater 116 restores the temperature of the water to approximately 160°.

Cold water supply valve 174 and water inlet valve 180 are opened to establish a flow of cold water through water inlet line 178, water supply header 80, water supply ports 86, under the layer of wax 194 in cavity 23, through water drainage ports 52 and weir chamber 34, over weir 40, into trough 36 and finally into sump 12 via weir overflow conduit 185. This circulation of cold water solidifies wax layer 194 and raises the layer slightly above the lower edges of upper screeding channels 48 and 82. Because pump 108 is not drawing water from sump 12, this cold water will flow over overflow weir 104 in sump 12 and will pass out of the system through sump overflow line 100 to an appropriate drain. In the event the system is being used in an area where water is scarce and/or expensive, this water may be recycled for subsequent use.

The flow of cold water 193 under wax layer 194 is continued until wax 194 has solidified to a consistency which is sufficient to support a concrete pour. By this time the wax layer 194 will have shrunk to the level indicated at 196, which coincides with the bottom edges of upper screeding channels 48 and 82. Cold water circulation is continued while a layer of concrete 198 is ooured onto wax layer 194. This circulation continues until the concrete 198 has established some preset.

Once the second layer of concrete 198 has preset sufficiently to be supported by structural support member 190, cold water supply valve 174 is closed, and water drain valve 94 is opened to permit the water in cavity 23 to drain through water drain line 92 and into sump 12. When substantially all of the water has drained from cavity 23, water drain valve 94 is closed, and hot water supply valve 146 is opened to restore the flow of water under wax layer 194 and over weir 40. At this point, three-way valve 112 is rotated 90° in a counterclockwise direction to establish circulation of hot water through system 110.

As soon as wax dam 58 has warmed sufficiently to be free, the wax dam is moved to its raised position, thereby opening wax drainage slots 54 to permit the melting wax to flow through the wax drainage slots, into weir chamber 34, over weir 40 into trough 36 and sump 12. When substantially all of the wax has melted, weir chamber drain valve 182 is opened, permitting water and wax to flow through weir chamber drain line 184 and into sump 12. This drops the level of water in cavity 23 below weir 40 and in effect makes water drainage ports 52 another fixed weir. This will cause all of the wax to be passed into sump 12 and, via return line 106, pump 108, and separator tank inlet line 126 to separator tank 114. When the water is at this low level, hot water should be flushed through wax supply header 78 hy opening wax header heating valve 172 to clear any residual wax from the wax supply header.

When it appears that all of the wax has been removed, water drain valve 182 is closed, thus restoring the flow of hot water over weir 40. This circulation of hot water under the second layer of concrete 198 accelerates the curing time of the concrete. When curing is complete, hot water valve 145 is closed, and water drain valve 94 is opened to drain the hot water into sump 12. When sump 12 is nearly empty, three-way valve 112 should be rotated 90° in a clockwise direction so that the water will be circulated in its short circuit to restore heat to the water system.

Using jack screws 24 and 72, movable side channel 14 and movable end channel 16 are drawn outwardly permitting the cast concrete member to be lifted out of casting bed 10. When movable side channel 14 and movable end channel 16 are returned to their original positions, casting bed 10 and system 110 are ready for casting another concrete member.

The design of casting bed 10 is such that with minor design changes to the ends of movable side and end channels 14 and 16, the casting bed will be adapted to cast concrete panels of widely different dimensions. Of course, it should be understood that various other changes and modifications of the preferred embodiments described herein will be apparent to those skilled in the art. Such changes and modifications can be made without departing from the spirit and scope of the present invention and without diminishing its attended advantages. It is, therefore, intended that such changes and modifications be covered by the following claims.

We claim:

1. A method of forming a multiple layer concrete panel member in which the layers are spaced, comprising:

erecting and joining together a plurality of upstanding sidewall members on a relatively flat surface to define a peripheral form enclosure for defining the lateral limits and shape of the concrete layers to be formed, with said enclosure being upon at the top and bottom, sealing the joints between the plural sidewall members to enable lateral containment of water within said enclosure, pouring a first layer of wet concrete within said enclosure to a first predetermined level substantially below the top of said enclosure and to the lateral limits of said enclosure to close and seal the bottom of the enclosure and thereby form with said sidewall members a liquid-tight tank for containment of water within said enclosure above said layer, embedding structural means within the wet concrete of the first layer, with said structural means projecting upwardly from the first layer for joinder with a second layer to be formed, while the concrete of the first layer is still wet, introducing water into the enclosure to fill the enclosure with said water from the top of the first concrete layer to a level below the top of the enclosure and containing such water within the confines of the enclosure and above the first layer, introducing into and containing within the enclosure a fusible wax material in molten form, the fusible wax material having a melting point above the temperature of the water and a density less than that of the water, to establish a layer of said fusible wax material on the surface of said water and coextensive therewith within the enclosure, with the upper level of the fusible wax material at a predetermined level below the top of the enclosure and below the upper limits of the structural means, after the fusible wax material has solidified on the surface of said water, pouring a second layer of concrete into the enclosure to the lateral limits thereof and onto the surface of the fusible wax material to embed the upper portions of the structural means within the second layer, after the second layer of concrete is at least partially cured, melting the layer of fusible wax material, draining the molten fusible wax material and water from the enclosure through drainage opening means in at least one of the sidewall members, establishing a weir within a chamber of a first sidewall member and liquid drainage opening means in the same sidewall member below the top of the weir, and introducing the water into the enclosure to fill the enclosure to a water level above the level of the discharge opening and below the level of the top of the weir, introducing the molten fusible wax material into the enclosure, and continuing the introduction of either the molten fusible wax material or the water until the water overflows the top of the weir to establish said predetermined level of the fusible wax material.

2. The method of claim 1 including melting the layer of solidified fusible wax material to enable its drainage from the enclosure by introducing a warm fluid at a temperature above the melting point of the fusible wax material into the enclosure through an inlet opening means in a sidewall member at a level between the upper surface of the first layer of concrete and the lower surface of the first layer of fusible wax material.

3. The method of claim 2 including introducing warm water into the enclosure through said inlet opening means while discharging the original water from the enclosure through said drainage opening means.

4. The method of claim 1 including introducing the water and molten fusible wax material into the enclosure through respective inlet ports in a sidewall member.

5. The method of claim 1 including damming the molten fusible wax material against lateral flow substantially beyond the confines of said enclosure at a level above the liquid drainage opening means during introduction of the fusible wax material into the enclosure to prevent its drainage from the enclosure and to form the layer of fusible wax material, and after the second layer of concrete has been poured, draining the melted fusible wax material from the enclosure through an opening in the first sidewall member at a level above the liquid drainage opening means to remove the layer of fusible wax material from the enclosure.

6. The method of claim 1 including introducing all water and fusible wax material into the enclosure and removing all water and molten fusible wax material from the enclosure through ports in the sidewall members.

7. The method of claim 5 including introducing the water and fusible wax material through a first sidewall member and discharging the water and fusible wax material through a second sidewall member.

8. The method of claim 1 including separating at least two adjoining said sidewall members from each other and from the remaining sidewall members after all water and fusible wax material have been drained from the enclosure to enable removal of the finished panel member from the enclosure.

9. A method of forming a multiple layer concrete panel member in which the layers are spaced apart but interconnected by structural means, the method comprising:

erecting and joining together a plurality of upstanding sidewall members to define peripheral form enclosure means for defining the lateral limits and shape of the concrete layers to be formed, pouring a first layer of concrete within the enclosure means to a first predetermined level substantially below the upper limits of the enclosure means and to the lateral limits of the enclosure means, embedding structural means within the first layer, with such structural means projecting upwardly from the first layer for joinder with a second layer to be formed, introducing water into the enclosure means to fill the enclosure means with said water from the top of the first layer to a level below the upper limits of the enclosure means and structural means, introducing into the enclosure means a fusible wax material in molten form, the fusible wax material having a melting point above the temperature of the water and a density less than that of the water, to establish a layer of said fusible wax material on the surface of said water, with the upper level of the fusible wax material at a predetermined level below the upper limits of the enclosure means and structural means, after the fusible wax material has solidified on the surface of the water, pouring a second layer of concrete into the enclosure means to the lateral limits thereof and onto the surface of the fusible wax material to embed the upper portions of the structural means with the second layer, after the second layer of concrete is at least partially cured, melting the layer of fusible wax material and removing it from the enclosure means, establishing a weir externally of the enclosure means but in fluid communication with the interior of the enclosure means through liquid drainage means from the enclosure means below the top of the weir, and continuing to introduce either the water or the molten fusible wax material into the enclosure means until the water overflows the weir to establish said predetermined level of fusible wax material, damming the molten fusible wax material against lateral flow over the weir at a level above the liquid drainage means during introduction of the molten fusible wax material into the enclosure means to enable establishing the layer of solidified fusible wax material, and after the second layer of concrete has been poured, releasing the dam to drain the melted fusible wax material from the enclosure over the weir.

10. A method of forming a concrete panel member in a mold structure having a plurality of laterally upstanding walls on a floor defining a cavity, with water and fusible wax material distribution conduit means extending through at least one of said upstanding walls and with a drainage conduit extending through a second upstanding wall and leading to a weir having an upper edge below the upper limit of the walls, comprising:

introducing water into the cavity through the liquid distribution conduit means to a predetermined level above the drainage conduit and below the weir upper edge;

establishing the upper edge of the weir above the level of the drainage conduit;

forming a layer of fusible wax material on the surface of the water, the fusible wax material being of lesser density than the water and having a melting point which is above the temperature of the water, by introducing molten fusible wax material into the cavity through the fusible wax material distribution means while damming the molten fusible wax material against lateral flow over the weir at a level above the liquid drainage means, and continuing to introduce water or molten fusible wax material into the cavity until the water begins to flow over the weir, whereby the upper level of the fusible wax material is determined by the height of the weir;

after the fusible wax material has solidified, introducing a concrete mix into the cavity above the fusible wax material;

when the concrete mix is at least partially cured, establishing a flow of warm water into the cavity through the liquid distribution means and below the fusible wax material and over the weir, the warm water having a temperature above the melting point of the fusible wax material so that the fusible wax material is melted;

releasing the dam to drain the molten fusible wax material from the cavity over the weir; and draining the water from the cavity through the drainage conduit.

* * * * *

UNITED STATES PATENT AND TRADEMARK OFFICE

CERTIFICATE OF CORRECTION

PATENT NO. : 4,591,474

DATED : May 27, 1986

INVENTOR(S) : Harold H. Scott and Ralph K. Scott

It is certified that error appears in the above-identified patent and that said Letters Patent is hereby corrected as shown below:

Column 4, line 26, "oermit" should be --permit--;
Column 4, line 53, "L-shaoed" should be --L-shaped--;

Column 6, line 29, "aporopriate" should be --appropriate--;
Column 9, line 43, "upoer" should be --upper--;

Column 9, line 52, "ooened" should be --opened--;
Column 9, line 63, "he" should be --be--;
Column 10, line 32, "ooured" should be --poured--; and
Column 10, line 61, "hy" should be --by--.

Column 11, line 27, "spaced" should be --spaced apart--;
Column 11, line 33, "upon" should be --open--;
Column 12, line 27, delete "first".

Signed and Sealed this

Second Day of December, 1986

*Attest:*

DONALD J. QUIGG

*Attesting Officer*

*Commissioner of Patents and Trademarks*